US010368639B1

(12) United States Patent
Lai et al.

(10) Patent No.: US 10,368,639 B1
(45) Date of Patent: Aug. 6, 2019

(54) BUTT-JOINING AND POSITIONING STRUCTURE OF VERTICAL BAR WITH HOOK HOLE

(71) Applicant: Shenter Enterprise Co., Ltd., Chang-Hua Hsien (TW)

(72) Inventors: Ming-Hsiao Lai, Chang-Hua Hsien (TW); Kuo-Shu Huang, Changhua (TW)

(73) Assignee: SHENTER ENTERPRISE CO., LTD., Chang-Hua Hsien (TW)

( * ) Notice: Subject to any disclaimer, the term of this patent is extended or adjusted under 35 U.S.C. 154(b) by 0 days.

(21) Appl. No.: 16/030,308

(22) Filed: Jul. 9, 2018

(51) Int. Cl.
*A47B 95/00* (2006.01)
*A47B 96/14* (2006.01)

(52) U.S. Cl.
CPC ..... *A47B 95/00* (2013.01); *A47B 96/1433* (2013.01); *A47B 96/1441* (2013.01); *A47B 2220/00* (2013.01)

(58) Field of Classification Search
CPC . A47B 95/00; A47B 96/1441; A47B 96/1433; A47B 2220/00
USPC ..... 211/190–193; 256/65.02, 65.04, 65.05, 256/65.06; 52/655.1, 656.2; 108/180; 248/220.21, 220.31, 220.42, 220.43, 248/224.8, 235, 250, 304, 339
See application file for complete search history.

(56) References Cited

U.S. PATENT DOCUMENTS 2,926,941 A * 3/1960 Thompson ..... A47B 47/0008 403/173
3,153,299 A * 10/1964 Jennings ..... G09B 25/04 403/173
3,325,017 A * 6/1967 Tucker ..... A47B 57/42 211/187
3,349,532 A * 10/1967 Dudoff ..... E04B 2/7433 256/65.02
3,358,848 A * 12/1967 Johnsson ..... A47B 57/16 211/182
3,468,430 A * 9/1969 Lawman ..... A47F 5/14 211/182
3,522,933 A * 8/1970 Braun ..... E04F 11/181 256/22
3,589,310 A * 6/1971 Tucker ..... A47B 47/03 108/108

(Continued)

*Primary Examiner* — Jonathan Liu
*Assistant Examiner* — Devin K Barnett
(74) *Attorney, Agent, or Firm* — Egbert Law Offices, PLLC

(57) ABSTRACT

A structure includes: two abutted vertical bars having a rectangular tube shape; a plurality of hook hole groups on the side wall thereof; the side walls of the vertical bars are provided with first and second locking through holes, respectively, at the place adjacent to the butt-joining opening thereof; a hook hole group is arranged between one butt-joining opening and the first or second locking through hole; a bidirectional plug-in butt-joining member is assembled between the two butt-joining openings at the opposite ends of the two vertical bars, and the bidirectional plug-in butt-joining member further includes recess portions that are aligned with the hook hole groups arranged on the vertical bar adjacent to the butt-joining opening; and first and second positioning holes arranged on the side wall of the bidirectional plug-in butt-joining member and aligned with the respective locking through holes for locking through the respective locking member.

6 Claims, 6 Drawing Sheets

(56) References Cited

U.S. PATENT DOCUMENTS 3,625,372 A * 12/1971 MacKenzie ..... A47B 57/402 211/191
3,647,080 A * 3/1972 Denny ..... A47B 47/027 108/901
3,797,948 A * 3/1974 Weininger ..... F16B 12/40 403/187
4,406,374 A * 9/1983 Yedor ..... A47B 57/40 211/192
4,425,049 A * 1/1984 Travis ..... A47B 57/50 403/237
4,643,319 A * 2/1987 Debus ..... H02B 1/01 211/182
4,934,858 A * 6/1990 Beaulieu ..... F16B 12/40 403/174
5,272,991 A * 12/1993 Carrigan, Jr. ..... A47B 87/0207 108/108
5,284,311 A * 2/1994 Baer ..... A47B 57/402 248/243
5,289,665 A * 3/1994 Higgins ..... E04B 1/2403 211/191
5,377,851 A * 1/1995 Asano ..... A47B 47/022 211/191
5,660,017 A * 8/1997 Houghton ..... E04B 1/2403 52/167.3
5,680,737 A * 10/1997 Sheipline ..... E04B 1/24 403/169
5,797,501 A * 8/1998 Von Gunten ..... A47B 57/42 108/180
5,899,035 A * 5/1999 Waalkes ..... E04B 2/7433 52/239
6,032,431 A * 3/2000 Sugiyama ..... E04B 1/2604 52/656.9
6,089,387 A * 7/2000 Varfolomeeva ..... A47B 57/06 211/106
6,129,224 A * 10/2000 Mingers ..... A47B 57/482 211/190
6,315,137 B1 * 11/2001 Mulford ..... A47B 57/565 211/193
6,595,379 B1 * 7/2003 Powell ..... A47B 57/50 211/192
6,682,253 B2 * 1/2004 Binna ..... A47B 57/26 403/263
6,769,556 B1 * 8/2004 Holscher ..... A47B 47/022 211/193
6,905,109 B2 * 6/2005 Mills ..... E04H 17/1413 256/65.02
7,264,416 B2 * 9/2007 Kahl ..... F16B 7/18 211/182
7,575,212 B1 * 8/2009 Langelius ..... A47B 57/42 211/192
7,762,038 B2 * 7/2010 Ceba ..... E04B 1/2403 52/653.1
8,172,098 B2 * 5/2012 Eustace ..... A47B 47/021 211/189
8,210,362 B2 * 7/2012 Schell ..... H02B 1/21 211/26
8,844,211 B2 * 9/2014 Pensi ..... A47B 96/027 52/36.6
9,456,688 B2 * 10/2016 Moyer ..... A47B 47/0091
9,765,805 B2 * 9/2017 Pond ..... F16B 17/00
10,206,506 B1 * 2/2019 Lai ..... A47B 95/00
2002/0153341 A1 * 10/2002 May ..... A47B 57/402 211/192
2004/0200794 A1 * 10/2004 De Rijk ..... A47B 57/32 211/191
2007/0062898 A1 * 3/2007 Choi ..... A47B 57/408 211/192
2007/0186503 A1 * 8/2007 Homma ..... E04B 1/2604 52/655.1
2007/0261356 A1 * 11/2007 Vaughn ..... E02D 27/34 52/655.1
2009/0107944 A1 * 4/2009 Goldberg ..... A47B 57/48 211/192
2010/0071302 A1 * 3/2010 Antonic ..... E04B 1/28 52/653.1
2010/0205891 A1 * 8/2010 Bong ..... B23K 33/004 52/655.1
2012/0187065 A1 * 7/2012 Song ..... A47B 55/00 211/191
2013/0125497 A1 * 5/2013 Kumakawa ..... E04B 1/48 52/655.1
2013/0326993 A1 * 12/2013 Schold ..... E04B 1/185 52/655.1
2015/0167289 A1 * 6/2015 Wang ..... E04H 1/04 52/236.3

* cited by examiner

BUTT-JOINING AND POSITIONING STRUCTURE OF VERTICAL BAR WITH HOOK HOLE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a vertical bar butt-joining and positioning structure for a storage shelf, and more particularly to an innovative butt-joining and positioning structure of vertical bar with hook hole.

2. Description of Related Art Including Information Disclosed Under 37 CFR 1.97 and 37 CFR 1.98

The common storage shelf structure body is usually constructed of a plurality of vertical bars and cross bars, wherein each vertical bar can be composed of a single bar body. However, when the height of the storage shelf gets higher, butt-joining two unit bar bodies in an up-and-down manner will also be adopted to form the vertical bar.

The common up-and-down butt-joining configuration with unit bar bodies for the vertical bar of a conventional storage shelf is that each unit bar body is provided with a reduced diameter section at one end. The outer diameter of the reduced diameter section can fit tightly into the end opening of another butt-joined unit bar body, or through the manner of threaded rod screwed into the screw hole to achieve the up-and-down butt joining and positioning state of the unit bar bodies. Alternatively, in industry circles, the upper and lower ends of each unit bar body are made into a straight tube opening configuration, and a double-headed connector is additionally made. The double-headed connector has two opposite oriented plug-in ends, which can be used to insert into the end openings of the two up-and-down butt-joining unit bar bodies, thereby achieving the up-and-down butt-joining and positioning state of the unit bar body.

However, the up-and-down butt-joining configuration with unit bar bodies for the vertical bar of a conventional storage shelf as described above still has some problems in actual application experience. For example, because the vertical bar configuration of the current storage shelf has some variation, the vertical bar and the cross bar of the storage shelf may adopt hooking and positioning manner to achieve a combination state. In this structural configuration, the corresponding side wall of the vertical bar is usually provided with a predetermined type and number of hooking hole groups for hooking and matching with the hook body at the end portion of the cross bar. However, if the vertical bar of the storage shelf adopts the aforementioned conventional up-and-down butt-joining configuration with unit bar bodies, there will be an inner tube insertion section at the butt-joining place of the two unit bar bodies. If the side wall of the vertical bar corresponding to the insertion section is provided with a hook hole group, the hook body provided at the end portion of the cross bar cannot be hooked onto the hook hole group provided on the side wall of the vertical bar owing to the blockage of the inner tube wall, thus resulting in the drawbacks of integrity and flexibility in assembling the cross bars (Note: There is a section where the cross bars cannot be installed at the butt-joining place of the two unit bar bodies).

BRIEF SUMMARY OF THE INVENTION

The main purpose of the present invention is to provide a butt-joining and positioning structure of vertical bar with hook hole, and the technical problems to be solved is aimed at making a breakthrough to develop a more ideal and practical new type of butt-joining and positioning structure of vertical bars.

Based on the foregoing objective, the technical features of the present invention to solve the problem are that the butt-joining and positioning structure of vertical bar with hook hole comprises: two vertical bars that are up-and-down butt-joined and abutted against each other; each vertical bar is a rectangular hollow tube type, and comprises four side walls, wherein at least two side walls are provided with a plurality of hook hole groups up-and-down arranged at intervals; both ends of the vertical bar have a butt-joining opening, respectively, and the side walls of the hook hole group of the vertical bars are provided with a first locking through hole 131 and a second locking through hole, respectively, at the place adjacent to each butt-joining opening; a hook hole group is arranged between one of the butt-joining openings and the second locking through hole or the first locking through hole, so that when the butt-joining openings at the opposite ends of the two vertical bars are butt-joined, the section adjacent to the butt-joining portion between the first locking through hole and the second locking through hole has a configuration of hook hole group; a bidirectional plug-in butt-joining member which is a bidirectional plug-in type assembled between the butt-joining openings at the opposite ends of the two vertical bars; the cross-sectional shape of the bidirectional plug-in butt-joining member must be fitted with the butt-joining openings of the vertical bars, and the bidirectional plug-in butt-joining member further includes at least two recess portions arranged on at least two side walls of the bidirectional plug-in butt-joining member; the at least two recess portions are aligned and communicated with the hook hole groups arranged on the vertical bar adjacent to the butt-joining opening, and the profile of the at least two recess portions must be larger than the profile of the hook hole group; at least one first positioning hole arranged on at least one side wall of the bidirectional plug-in butt-joining member and located at one end interval of at least one recess portion; the position of each first positioning hole is aligned with its corresponding first locking through hole for locking and positioning through the first locking member; at least one second positioning hole arranged on at least one side wall of the bidirectional plug-in butt-joining member and located at the other end interval of at least one recess portion; the position of each second positioning hole is aligned with its corresponding second locking through hole for locking and positioning through the second locking member.

With this innovative and unique design, in comparison with the prior art, the present invention can provide a better structural configuration of vertical bar with hook hole for achieving butt-joining and positioning, allowing the sections adjacent to the butt-joining portion at the ends of the two vertical bars to be hooked and combined to the end portions of the cross bars to meet the multiple and flexible requirements of the storage shelf structure and have practical advancement.

DETAILED DESCRIPTION OF THE INVENTION

Referring to FIGS. 1 to 5, which are the preferred embodiments of the butt-joining and positioning structure of vertical bar with hook hole of the present invention. However, these embodiments are for illustration purposes only, and are not limited by the patent applications.

Figure 4:
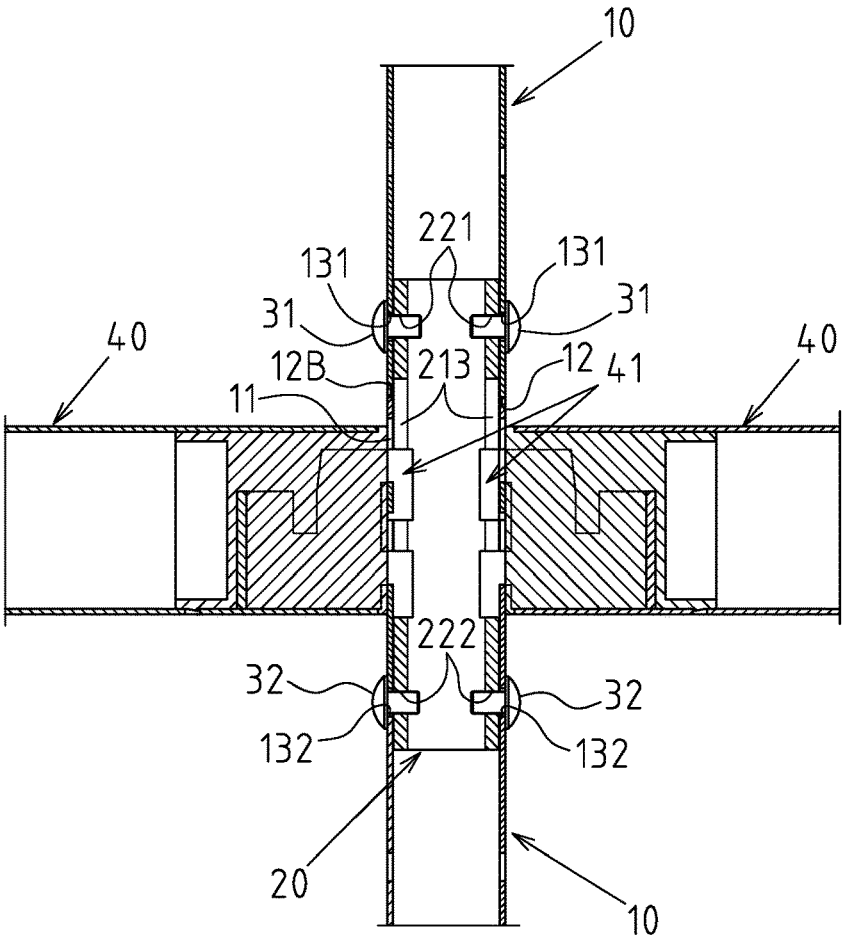
FIG. 4 is a longitudinal cross-sectional view of components combination of a preferred embodiment of the present invention.
Figure 5:
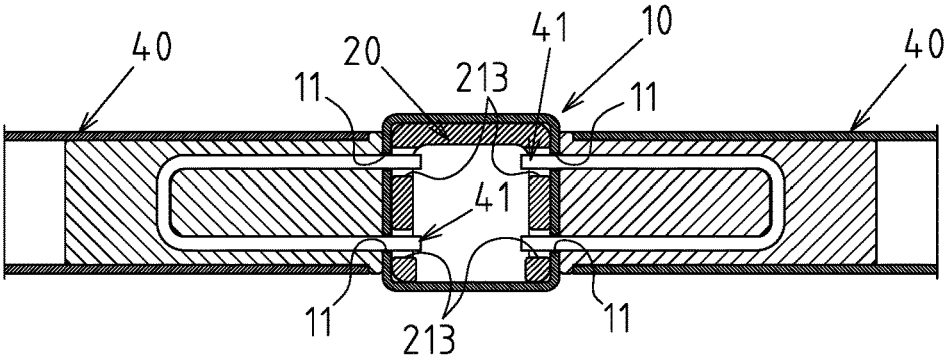
FIG. 5 is a transverse cross-sectional view of components combination of a preferred embodiment of the present invention.

The butt-joining and positioning structure of vertical bar with hook hole comprises the following components: two vertical bars 10 that are up-and-down butt-joined and abutted against each other; each vertical bar 10 is a rectangular hollow tube type, and comprises four side walls, wherein at least two side walls are provided with a plurality of hook hole groups 11 up-and-down arranged at intervals; both ends of the vertical bar 10 have a butt-joining opening 12, 12B, respectively, and the side walls of the hook hole group 11 of the vertical bars 10 are provided with a first locking through hole 131 and a second locking through hole 132, respectively, at the place adjacent to each butt-joining opening 12, 12B; a hook hole group 11 is arranged between one of the butt-joining openings 12, 12B and the second locking through hole 132 (or the first locking through hole 131), so that when the butt-joining openings 12, 12B at the opposite ends of the two vertical bars 10 are butt-joined (as shown in FIGS. 4 and 5), the section adjacent to the butt-joining portion between the first locking through hole 131 and the second locking through hole 132 has a configuration of hook hole group 11; a bidirectional plug-in butt-joining member 20 which is a bidirectional plug-in type assembled between the butt-joining openings 12, 12B at the opposite ends of the two vertical bars 10; the cross-sectional shape (which will be described later in detail) of the bidirectional plug-in butt-joining member 20 must be fitted with the butt-joining openings 12, 12B of the vertical bars 10, and the bidirectional plug-in butt-joining member 20 further includes at least two recess portions 21 arranged on at least two side walls of the bidirectional plug-in butt-joining member 20; the at least two recess portions 21 are aligned and communicated with the hook hole groups 11 arranged on the vertical bar 10 adjacent to the butt-joining opening 12B, and the profile of the at least two recess portions 21 must be larger than the profile of the hook hole group 11; at least one first positioning hole 221 arranged on at least one side wall of the bidirectional plug-in butt-joining member 20 and located at one end interval of at least one recess portion 21; the position of each first positioning hole 221 is aligned with its corresponding first locking through hole 131 for locking and positioning through the first locking member 31; at least one second positioning hole 222 arranged on at least one side wall of the bidirectional plug-in butt-joining member 20 and located at the other end interval of at least one recess portion 21; the position of each second positioning hole 222 is aligned with its corresponding second locking through hole 132 for locking and positioning through the second locking member 32.

Figure 1:
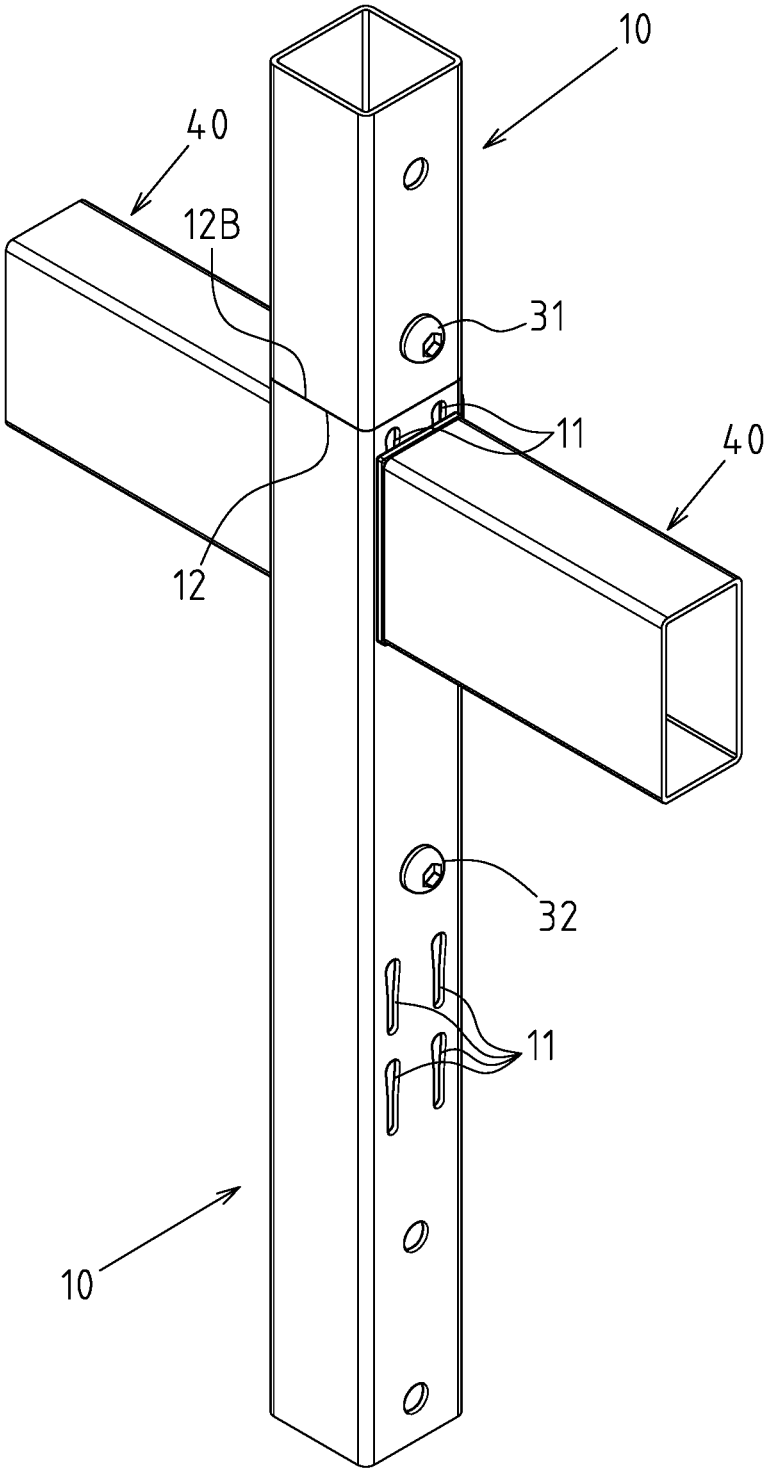
FIG. 1 is a components combination three-dimensional diagram of a preferred embodiment of the present invention.
Figure 2:
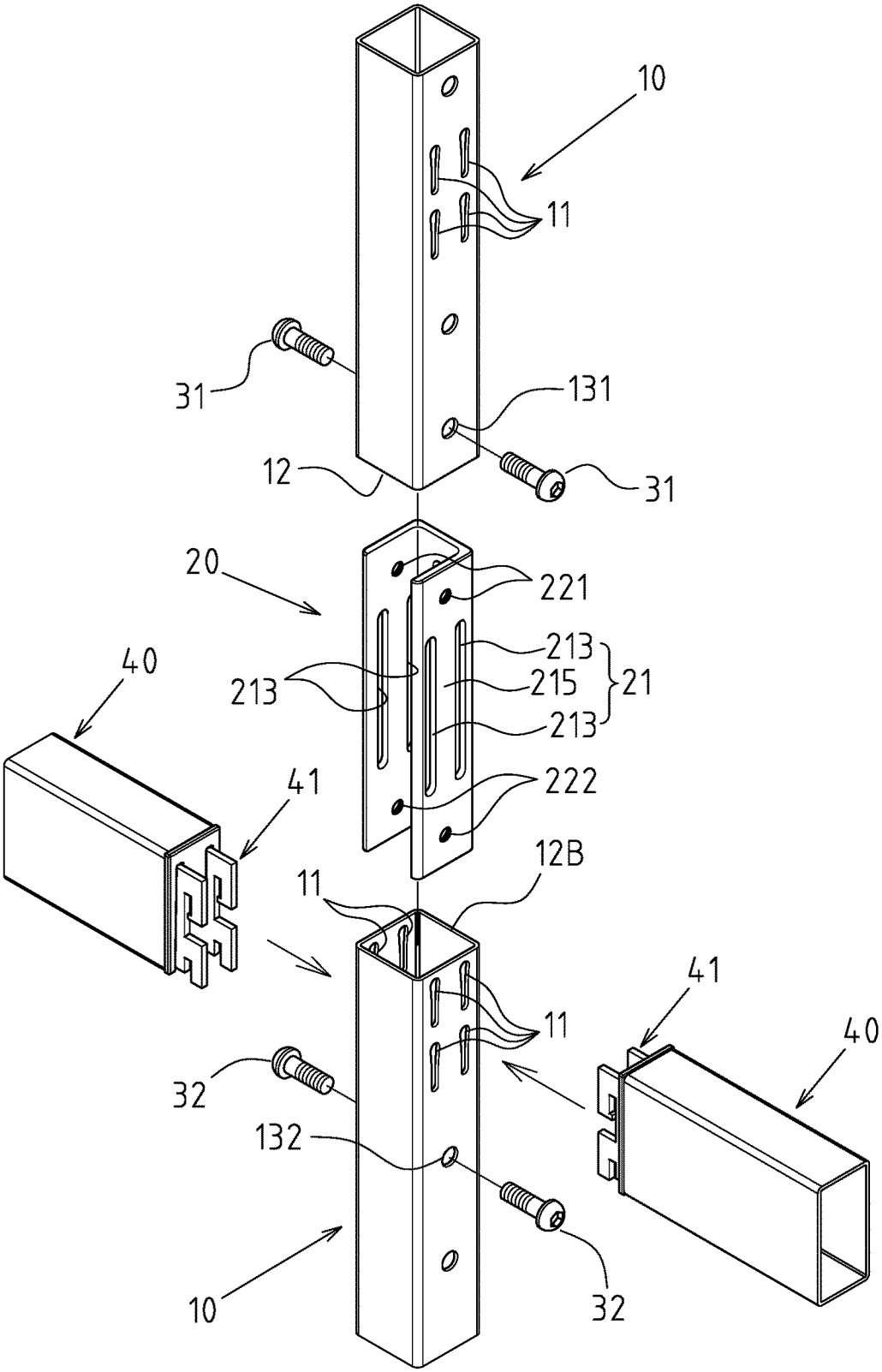
FIG. 2 is a components decomposition three-dimensional diagram of a preferred embodiment of the present invention.

As shown in FIG. 2, in this embodiment, each recess portion 21 includes two elongated holes 213 that are disposed at intervals on the side walls of the bidirectional plug-in butt-joining member 20. A spacer rib 215 is formed between the two elongated holes 213, and the extending direction of the two elongated holes 213 is parallel to the extending direction of the bidirectional plug-in butt-joining member 20 (Note: In the drawing of this embodiment, the extending directions of both the elongated holes 213 and the bidirectional plug-in butt-joining member 20 are up and down direction). In this embodiment, the spacer rib 215 formed between the two elongated holes 213 can form a flexural reinforcement effect to the structure of bidirectional plug-in butt-joining member 20.

With the structural pattern and technical features of the above structure, the practical applications of the butt-joining and positioning structure of vertical bar with hook hole disclosed in the present invention are shown in FIGS. 1 to 5. The two vertical bars 10 are abutted against each other with the butt-joining openings 12, 12B, and the bidirectional plug-in butt-joining member 20 in a bidirectional plug-in configuration is inserted into the butt-joining openings 12, 12B at the opposite ends of the two vertical bars 10, wherein the recess portion 21 of the bidirectional plug-in butt-joining member 20 and the hook hole group 11 of the vertical bar 10 at close to the butt-joining opening 12B are aligned with each other. The first positioning hole 221 of the bidirectional plug-in butt-joining member 20 and the first locking through hole 131 of the vertical bar 10 are aligned, and locked and positioned through the first locking member 31. The second positioning hole 222 of the bidirectional plug-in butt-joining member 20 and the second locking through hole 132 of the vertical bar 10 are aligned, and locked and positioned through the second locking member 32. Under the state that the ends of the two vertical bars 10 achieves butt-joining and positioning, the hook hole group 11 of the vertical bar 10 at close to the butt-joining opening 12B can be provided for the alignment with the hook group 41 at the end portion of the cross bar 40 to achieve positioning state, and, through the technical feature of the recess portion 21 of the bidirectional plug-in butt-joining member 20 aligned with the hook hole group 11 of the vertical bar 10, the aforementioned hook group 41 can successfully achieve hooking function, so that the butt-joining sections at the end portions of the two vertical bars 10 can be provided for the hooking and combining function for the end portions of the cross bars 40 to meet the multiple and flexible requirements of the storage shelf structure.

Figure 6:
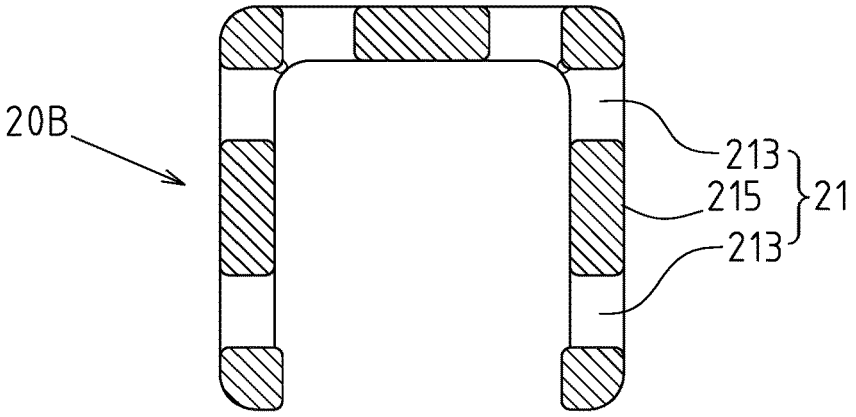
FIG. 6 is a first variation of the bidirectional plug-in butt-joining member of the present invention.
Figure 7:
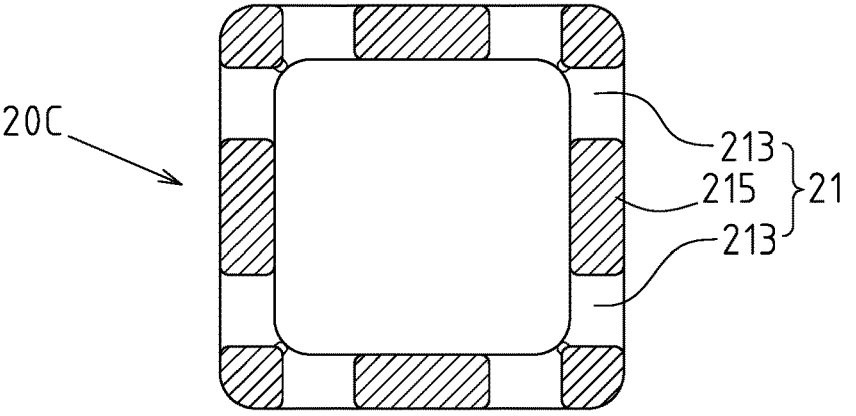
FIG. 7 is a second variation of the bidirectional plug-in butt-joining member of the present invention.
Figure 8:
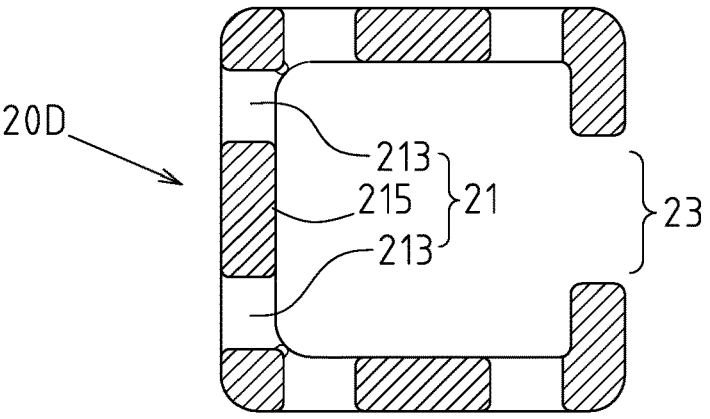
FIG. 8 is a third variation of the bidirectional plug-in butt-joining member of the present invention.

The cross section of the bidirectional plug-in butt-joining member can be any shape of U-shaped, hollow rectangular, C-shaped with a notch 23, and II-shaped. Specifically, the cross section of the bidirectional plug-in butt-joining member 20, as shown in FIGS. 2 and 5, is U shape, and has three sidewalls that are formed by continuously bending orthogonally at 90 degrees and the other side is an open side. The recess portions 21 may be a type provided on the opposite side walls. It may also be a bidirectional plug-in butt-joining member 20B, as shown in FIG. 6, wherein the recess portions 21 are disposed on the three side walls. The cross section of the bidirectional plug-in butt-joining member 20C shown in FIG. 7 is a hollow rectangular shape and has enclosed four side walls. The hollow rectangular shape includes specific shape of a square or a rectangle. In this embodiment, the advantage is that the recess portion 21 can be arranged on all four side walls, and the expandability of the shelf body is the best. However, in such a hollow rectangular shape, the recess portion 21 can also be arranged on two or three side walls. In addition, the cross section of the bidirectional plug-in butt-joining member 20D, as shown in FIG. 8, is in C shape with a notch 23 forming on one side, which is also a practical implementation type. Compared to the U-shaped cross section, this embodiment has better rigidity.

Figure 3:
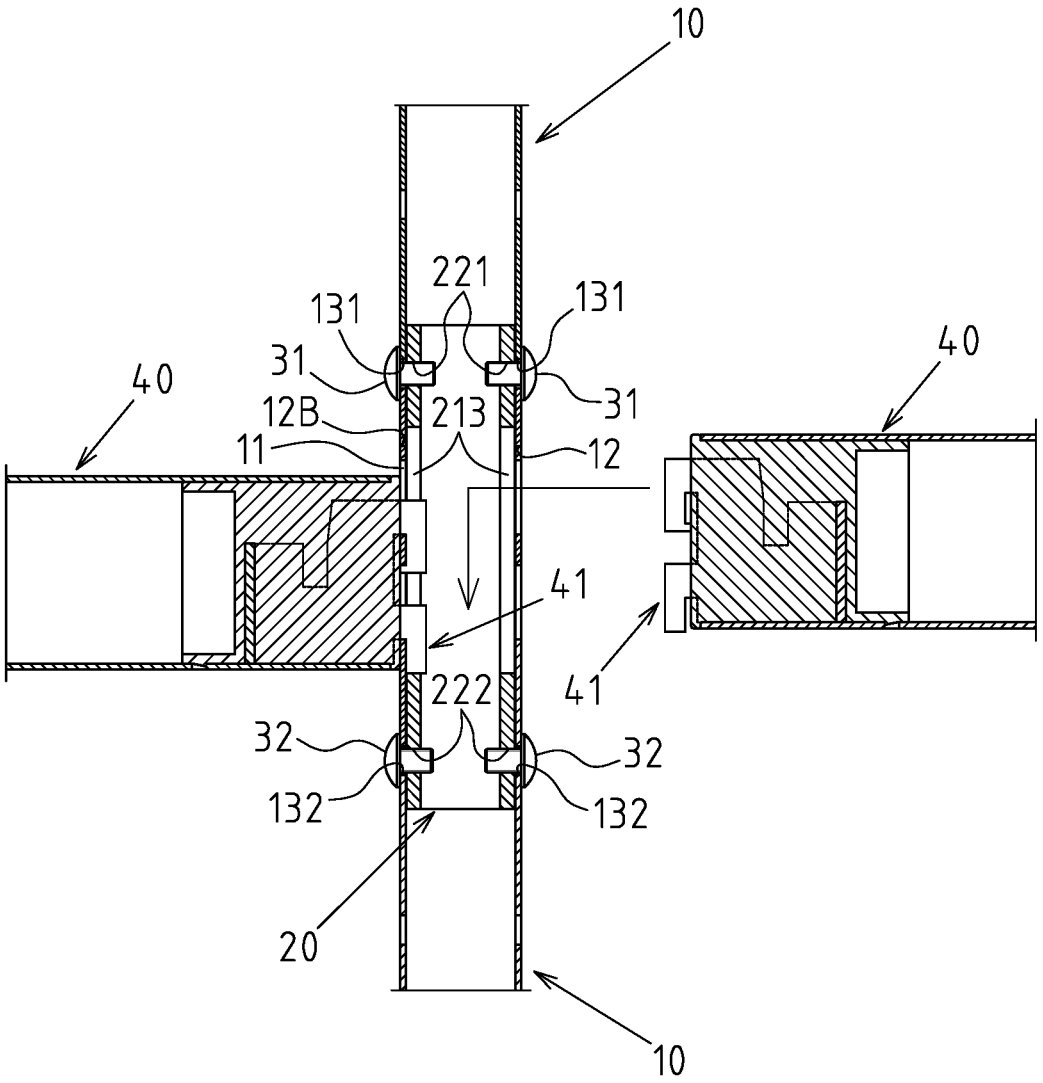
FIG. 3 is a longitudinal cross-sectional view of components partial combination of a preferred embodiment of the present invention.

As shown in FIGS. 2 and 3, in this embodiment, the first positioning hole 221 and the second positioning hole 222 are screw holes, and the first locking member 31 and the second locking member 32 are configured as bolts.

Figure 9:
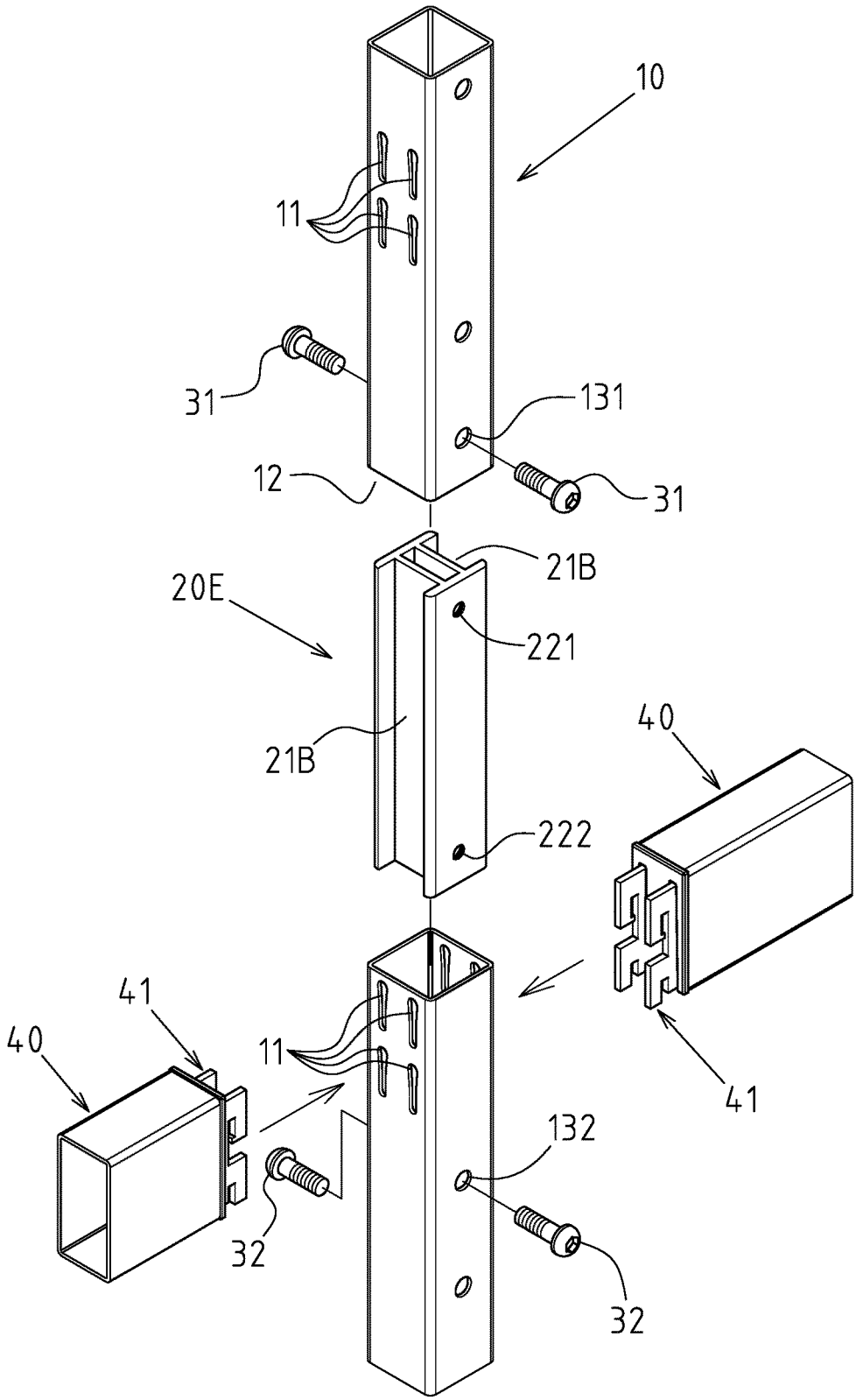
FIG. 9 is a fourth variation of the bidirectional plug-in butt-joining member of the present invention.

As shown in FIG. 9, in this embodiment, each recess portion 21B of the bidirectional plug-in butt-joining member 20E is so constructed that the corresponding side wall is configured as an inwardly concave type. Moreover, the cross section of the bidirectional plug-in butt-joining member 20E disclosed in this embodiment is II-shaped, and this type of configuration may be constructed from aluminum extruded material. It is worth mentioning that in this embodiment, the recess portion 21B and the first positioning hole 221 together with the second positioning hole 222 are respectively arranged on different side walls of the bidirectional plug-in butt-joining member 20E, which is also a practical implementation type.

Furthermore, as shown in FIGS. 2 and 3, the butt-joining position of the butt-joining openings 12, 12B at the opposite ends of the two vertical bars 10 corresponds to the position between one end of the recess portion 21 provided on the bidirectional plug-in butt-joining member 20 and the first positioning hole 221 (or the second positioning hole 222).

It is additionally noted that the first positioning holes 221 and the second positioning holes 222 shown in the drawing of the embodiment are respectively arranged on the two opposite side walls, so that the first locking members 31 and the second locking members 32 are two sets of pair locking type. However, if the vertical bar 10 and the bidirectional plug-in butt-joining member 20 are made of metal materials, only a single lateral locking with the first locking member 31 and the second locking member 32 is sufficient to achieve a firm state. Therefore, it suffices to set at least one first positioning hole 221 and at least one second positioning hole 222.

We claim:

1. A storage shelf structure comprising:

two vertical bars that abut each other, wherein a first vertical bar from said two vertical bars is on top of a second vertical bar from said two vertical bars; wherein the first vertical bar and the second vertical bar are parallel to each other; wherein each vertical bar is a rectangular hollow tube having four side walls, wherein at least two side walls from said four side walls each have a plurality of hook holes formed therein arranged at intervals; wherein opposite ends of each vertical bar have a butt-joining opening respectively, wherein each of the at least two side walls from said four side walls of each vertical bar have a first locking through hole and a second locking through hole that are spaced apart from the hook holes of each vertical bar respectively; wherein the hook holes of the second vertical bar are arranged between one of the butt-joining openings of the second vertical bar and the second locking through hole or the first locking through hole of the second vertical bar; and a bidirectional plug-in butt-joining member comprising at least three side walls, wherein two side walls from said at least three side walls each have:

a first positioning hole, a second positioning hole, and two elongated holes located between the first positioning hole and the second positioning hole, wherein the two elongated holes each have a first height and the hooks holes of the first and second vertical bars each have a second height; wherein the first height is approximately twice the size of the second height;

wherein the bidirectional plug-in butt-joining member is inserted within a corresponding butt-joining opening from said butt-joining openings of each of the vertical bars respectively so that a top portion of the bidirectional plug-in butt-joining member is located within the first vertical bar and a bottom portion of the bidirectional plug-in butt-joining member is located within the second vertical bar;

wherein the elongated holes of the bidirectional plug-in butt-joining member align with the hook holes of the second vertical bar; the first positioning holes of the bidirectional plug-in butt-joining member align with the first locking through holes of the first vertical bar to receive a first pair of fasteners respectively to secure the first vertical bar to the bidirectional plug-in butt-joining member; and the second positioning holes of the bidirectional plug-in butt-joining member align with the second locking through holes of the second vertical bar to receive a second pair of fasteners respectively to secure the second vertical bar to the bidirectional plug-in butt-joining member;

at least one horizontal cross bar, wherein each horizontal cross bar has an end portion comprising a plurality of hooks; wherein the hooks of a first horizontal cross bar from said at least one horizontal cross bar are inserted through the hook holes of a corresponding side wall from said at least two side walls of the second vertical bar and the elongated holes from a corresponding side wall from said two side walls of the bidirectional plug-in butt-joining member to secure the first horizontal cross bar to the second vertical bar in a perpendicular orientation.

2. The storage shelf structure defined in claim 1, wherein a spacer rib is formed between each of two elongated holes respectively, and each of the elongated holes have a vertical orientation.

3. The storage shelf structure defined in claim 2, wherein a cross section of the bidirectional plug-in butt-joining member is U-shaped, rectangular, or C-shaped.

4. The storage shelf structure defined in claim 3, wherein the first positioning holes and the second positioning holes are screw holes, and the first pair of fasteners and the second pair of fasteners are bolts.

5. The storage shelf structure defined in claim 1, wherein a cross section of the bidirectional plug-in butt-joining member is U-shaped, rectangular, or C-shaped.

6. The storage shelf structure defined in claim 5, wherein the first positioning holes and the second positioning holes are screw holes, and the first pair of fasteners and the second pair of fasteners are bolts.

* * * * *